US006538631B1

(12) United States Patent
Kwon

(10) Patent No.: US 6,538,631 B1
(45) Date of Patent: Mar. 25, 2003

(54) CIRCUIT FOR DRIVING SOURCE OF LIQUID CRYSTAL DISPLAY

(75) Inventor: Oh-kyong Kwon, Seoul (KR)

(73) Assignee: NTek Research Co., Ltd., Seoul (KR)

( * ) Notice: Subject to any disclaimer, the term of this patent is extended or adjusted under 35 U.S.C. 154(b) by 110 days.

(21) Appl. No.: 09/630,712

(22) Filed: Aug. 2, 2000

(30) Foreign Application Priority Data

Aug. 5, 1999 (KR) ..... 99-32152

(51) Int. Cl.[7] ..... G09G 3/36

(52) U.S. Cl. ..... 345/96; 345/100; 345/98; 345/210; 345/209; 345/211

(58) Field of Search ..... 345/92, 94, 96, 345/100, 98, 95, 209, 210, 211

(56) References Cited

U.S. PATENT DOCUMENTS 5,041,823 A * 8/1991 Johnson et al. ..... 345/94
5,337,070 A * 8/1994 Kitajima et al. ..... 345/211
5,528,256 A * 6/1996 Erhart et al. ..... 345/96
6,046,719 A * 4/2000 Dingwall ..... 345/100
6,127,998 A * 10/2000 Ichikawa ..... 345/100
6,456,281 B1 * 9/2002 Rindal ..... 345/98

* cited by examiner

*Primary Examiner*—Matthew C. Bella
*Assistant Examiner*—Tam Tran
(74) *Attorney, Agent, or Firm*—Schweitzer Cornman Gross & Bondell LLP

(57) ABSTRACT

There is provided a source driving circuit in a liquid crystal display, which applies negative and positive video signals to source lines of the liquid crystal display including a first and second plates and a liquid crystal being inserted therebetween, in which each video signal is applied, with its voltage being divided two phases of polarity modulation and gray scale decision. The polarity modulation is accomplished through stepwise charging and discharging.

18 Claims, 24 Drawing Sheets

Fig.5A

Odd-numbered frame

| | DL#1 | DL#2 | DL#3 | DL#4 |
|---|---|---|---|---|
| GL#1 | + | + | + | + |
| GL#2 | + | + | + | + |
| GL#3 | + | + | + | + |
| GL#4 | + | + | + | + |

+ : Positive video signal

Fig.5B

Even-numbered frame

| | DL#1 | DL#2 | DL#3 | DL#4 |
|---|---|---|---|---|
| GL#1 | — | — | — | — |
| GL#2 | — | — | — | — |
| GL#3 | — | — | — | — |
| GL#4 | — | — | — | — |

— : Negative video signal

Fig.5C

Odd-numbered frame

| | DL#1 | DL#2 | DL#3 | DL#4 |
|---|---|---|---|---|
| GL#1 | + | + | + | + |
| GL#2 | — | — | — | — |
| GL#3 | + | + | + | + |
| GL#4 | — | — | — | — |

+ : Positive video signal  — : Negative video signal

Fig.5D

Even-numbered frame

| | DL#1 | DL#2 | DL#3 | DL#4 |
|---|---|---|---|---|
| GL#1 | — | — | — | — |
| GL#2 | + | + | + | + |
| GL#3 | — | — | — | — |
| GL#4 | + | + | + | + |

+ : Positive video signal  — : Negative video signal

Fig.5E

Odd-numbered frame

| | DL#1 | DL#2 | DL#3 | DL#4 |
|---|---|---|---|---|
| GL#1 | + | — | + | — |
| GL#2 | + | — | + | — |
| GL#3 | + | — | + | — |
| GL#4 | + | — | + | — |

+ : Positive video signal  — : Negative video signal

Fig.5F

Even-numbered frame

| | DL#1 | DL#2 | DL#3 | DL#4 |
|---|---|---|---|---|
| GL#1 | — | + | — | + |
| GL#2 | — | + | — | + |
| GL#3 | — | + | — | + |
| GL#4 | — | + | — | + |

+ : Positive video signal  — : Negative video signal

Fig.5G

Odd-numbered frame

| | DL#1 | DL#2 | DL#3 | DL#4 |
|---|---|---|---|---|
| GL#1 | + | — | + | — |
| GL#2 | — | + | — | + |
| GL#3 | + | — | + | — |
| GL#4 | — | + | — | + |

+ : Positive video signal  — : Negative video signal

Fig.5H

Even-numbered frame

| | DL#1 | DL#2 | DL#3 | DL#4 |
|---|---|---|---|---|
| GL#1 | — | + | — | + |
| GL#2 | + | — | + | — |
| GL#3 | — | + | — | + |
| GL#4 | + | — | + | — |

+ : Positive video signal  — : Negative video signal

CIRCUIT FOR DRIVING SOURCE OF LIQUID CRYSTAL DISPLAY

BACKGROUND OF THE INVENTION

1. Field of the Invention

The present invention relates to a liquid crystal display, in more particular, to a circuit for driving the source lines of a liquid crystal display, which reduces the consumption power thereof.

2. Discussion of Related Art

A liquid crystal display (LCD) draws growing attentions as a display device for displaying video signals and studies and researches for this device are being actively carried out. In general, the LCD is roughly divided into a liquid crystal panel part and a driving part. The liquid crystal panel includes a lower glass plate on which pixel electrodes and thin film transistors (TFTs) are arranged in matrix form, a upper glass plate on which a common electrode and a color filter layer are formed, and a liquid crystal layer filled between the upper and the lower glass plates.

The driving part includes a video signal processor for processing video signals externally inputted, a controller for receiving a composite synchronous signal outputted from the video signal processor, dividing it into horizontal and vertical synchronous signals and controlling timing in response to mode (NTSC, PAL or SECAM) selecting signal, a source driver for supplying a signal voltage to the source lines of the liquid crystal panel in response to the output signal of the controller, and a gate driver for sequentially applying driving voltages to the scanning lines of the liquid crystal panel in response to the output signal of the controller. There have been actively performed researches for reducing the consumption power of the liquid crystal display constructed as above.

A conventional circuit and method for driving the source of a LCD is explained with reference to the attached drawings.

FIG. 1 shows the configuration of a conventional TFT-LCD. Referring to FIG. 1, the TFT-LCD includes a liquid crystal panel 10 having pixels each of which is located at each of points where a plurality of gate lines GL and a plurality of source lines SL intersect each other, a source driver 20 for providing each pixel with a video signal through the source lines SL, and a gate driver 30 for selecting a certain gate line GL of the liquid crystal panel 10 to turn on plural pixels. Here, each pixel consists of a TFT 1 whose gate is connected to the gate line GL and whose drain is connected to the source line SL, a storage capacitor Cs connected to the source of the TFT 1 in parallel, and a liquid crystal capacitor Clc.

FIG. 2 shows the configuration of the source driver of the conventional TFT-LCD. In this drawing, a 384-channel 6-bit driver is illustrated as an example of the source driver. That is, each of R, G, and B data is 6-bit and the number of the column lines is equal to 384. Referring to FIG. 2, the source driver includes a shift register 21, a sampling latch 22, a holding latch 23, a digital/analog converter 24, and an output buffer 25.

The shift register 21 shifts the horizontal synchronous signal pulse HSYNC in response to a source pulse clock HCLK, to output a latch enable clock to the sampling latch 22. The sampling latch 22 samples and latches digital R, G, and B data by column lines in response to the latch enable clock outputted from the shift register 21. The holding latch 23 simultaneously receives the R, G, and B data latched by the sampling latch 22 in response to a load signal LD to latch the R, G, and B data. The digital/analog converter 24 converts the digital R, G, and B data stored in the holding latch 23 into analog R, G, and B data. Then, the output buffer 25 amplifies signal current corresponding to the R, G, and B data to output it to the source line of the liquid crystal panel.

The source driver constructed as above samples and holds the digital R, G, and B data during one horizontal period, converts it into the analog R, G, and B data, and current-amplifies it. Here, when the holding latch 23 holds R, G, and B data corresponding to the nth column line, the sampling latch 22 samples R, G, and B data corresponding to the (n+1)th column line.

FIG. 3 shows the gate driver of the conventional TFT-LCD. Referring to FIG. 3, the gate driver includes a shift register 31, a level shifter, and an output buffer 33. The shift register 31 shifts the vertical synchronous signal pulse VSYNC in response to a gate pulse VCLK, to sequentially enable the scanning lines. The level shifter 32 sequentially level-shifts a signal applied to the scanning lines to output it to the output buffer 33. By doing so, the plural scanning lines connected to the output buffer 33 are sequentially enabled.

A method for driving the conventional TFT-LCD constructed as above is explained below.

First of all, the sampling latch 22 of the source driver 20 sequentially receives video data corresponding to a single pixel and stores video data corresponding to the source lines SL. The gate driver 30 outputs a gate line selection signal GLSS to select one of the plural gate lines GL. Then, the TFT 1 connected to the selected gate line GL is turned on so as to apply the video data stored in the holding latch 23 to the drain thereof, thereby displaying the video data on the liquid crystal panel 10.

Subsequently, the above-described operation is repeated to display video data on the liquid crystal panel 10.

At this time, the source driver 20 provides VCOM, positive and negative video signals to the liquid crystal panel 10 to display the video data thereon.

FIG. 4 shows the voltage range of the video signals of FIG. 1. Referring to FIG. 4, the positive and the negative video signals are alternately supplied to the pixels every time frame is changed, in order not to directly apply DC voltage to the liquid crystal during operation of the TFT-LCD and, for this, the electrode of the TFT-LCD upper plate is provided with the VCOM that is the medium voltage between the positive and negative video signals. In case where the positive and negative video signals are alternately applied to the pixels on the bases of the VCOM, however, light transmission curves of the liquid crystal do not agree with each other, generating flicker.

Accordingly, for the purpose of reducing the generation of flicker, four inversion modes are employed as shown in FIGS. 5A and 5B, 5C and 5D, 5E and 5F, and 5G and 5H respectively.

FIGS. 5A and 5B show the frame inversion mode in which the polarity of a video signal is modulated only when the frame is changed, and FIGS. 5C and 5D show the line inversion mode in which the video signal polarity varies every time the gate line GL is changed. Furthermore, FIGS. 5E and 5F show the column inversion mode in which the video signal polarity varies when the source line and the frame are changed, and FIGS. 5G and 5H show the dot inversion in which the polarity changes whenever each source line SL and gate line GL are changed and the frame is changed. The picture quality is good in the order of the frame inversion, line inversion, column inversion, and dot inversion, and the number of times of polarity change becomes larger in proportion to the picture quality, to result in the increases in power consumption. This is explained below in detail with reference to the dot inversion mode for driving the conventional LCD shown in FIG. 6. FIG. 6 shows the waveform of a video signal applied to odd-numbered source lines SL or even-numbered source lines SL of the liquid crystal panel 10. This illustrates that the polarity of the video signal of the source lines SL is modulated at every gate line change on the basis of the VCOM.

Here, it is assumed that the entire TFT-LCD panel displays the same gray color, the variation width (V) of the video signal of the source lines SL becomes twice that of the VCOM plus positive video signal or that of the VCOM plus negative video signal. Accordingly, the conventional dot inversion consumes a large amount of power because the polarity of the video signal changes from positive to negative or from negative to positive on the basis of the VCOM at every time when the gate line GL is changed.

FIG. 6 shows the video signal swing width when a black image is displayed using the normally-white mode liquid crystal. In this case, every horizontal period requires a voltage swing with a wide width, this voltage swing being obtained by energy provided by the voltage power VDD of the output amplifier, and power consumption occurs at every two horizontal periods (period: H).

FIG. 7 is a circuit diagram of a general CMOS for driving a capacitance load. Referring to FIG. 7, the source of a PMOS transistor P1 is connected to a power supply $V_H$ and its drain is connected to the drain of an NMOS transistor N1 to construct an output side, the source of the NMOS transistor N1 is connected to other power supply $V_L$, the gates of the NMOS and the PMOS transistors N1 and P1 receive an output signal (or input signal) frequency F, and a load capacitor $C_{LOAD}$ is connected between the drains of the NMOS and the PMOS transistors N1 and P1 and the source of the NMOS transistor N1.

The consumption power of the conventional CMOS driving circuit constructed as above is represented by the following equation (1).

$$P_{CCNV}=C_{LOAD}\cdot V_H\cdot(V_H-V_L)\cdot F \quad (1)$$

where $C_{LOAD}$ indicates the capacitance of the load capacitor $C_{LOAD}$, and F indicates the output signal (or input signal) frequency, and $V_H>V_L$.

However, in the conventional method of driving the source of the LCD, a large amount of power consumption occurs at every two horizontal periods because the amount of power consumed for driving the source is proportional to the swing width of the video signal, requiring a large amount of consumption power.

SUMMARY OF THE INVENTION

Accordingly, the present invention is directed to a circuit for driving the source lines of a liquid crystal display that substantially obviates one or more of the problems due to limitations and disadvantages of the related art.

An object of the present invention is to provide a circuit for driving the source lines of a liquid crystal display, which reduces consumption power required for polarity conversion accompanying a voltage swing with a wide width and, at the same time, decreases the driving consumption power of an amplifier.

To accomplish the object of the present invention, there is provided a source driving circuit of a liquid crystal display, the source driving circuit having a shift register, a sampling latch, a holding latch, a digital/analog converter and an output buffer, the source driving circuit comprising: a first polarity modulator for performing polarity modulation of odd-numbered source lines; a second polarity modulator for performing polarity modulation of even-numbered source lines, opposite to the first polarity modulator; and a plurality of multiplexers or switches for selecting one of the output of the output buffer and the outputs of the first and the second polarity modulators in response to an external control signal, to output the selected one to pixels.

For the source driving circuit of a liquid crystal display of this invention, there is also provided a source driving method in a liquid crystal display, which applies negative and positive video signals to source lines of the liquid crystal display including a first and a second plates and a liquid crystal being inserted therebetween, in which each video signal is applied, with its voltage being divided two phases of polarity modulation and gray scale decision.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIGS. 5A–5H show inversion modes of TFT-LCD;

Figure 10A:
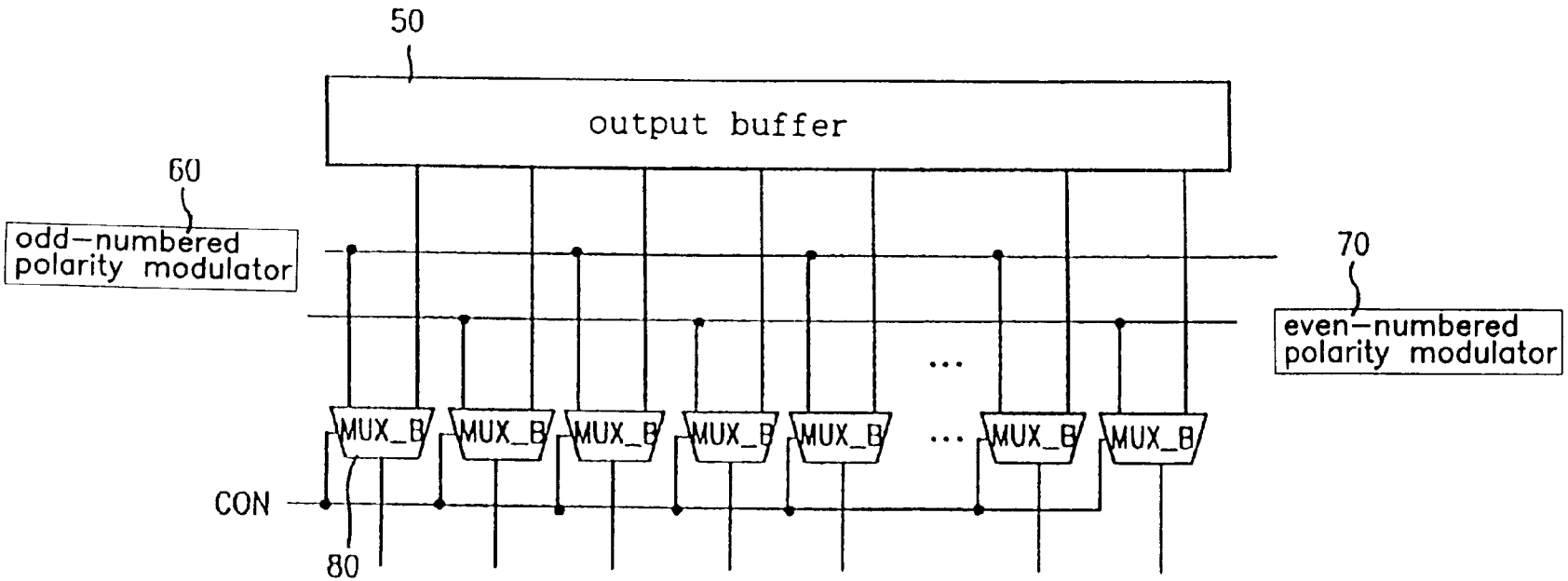
Figure 10B:
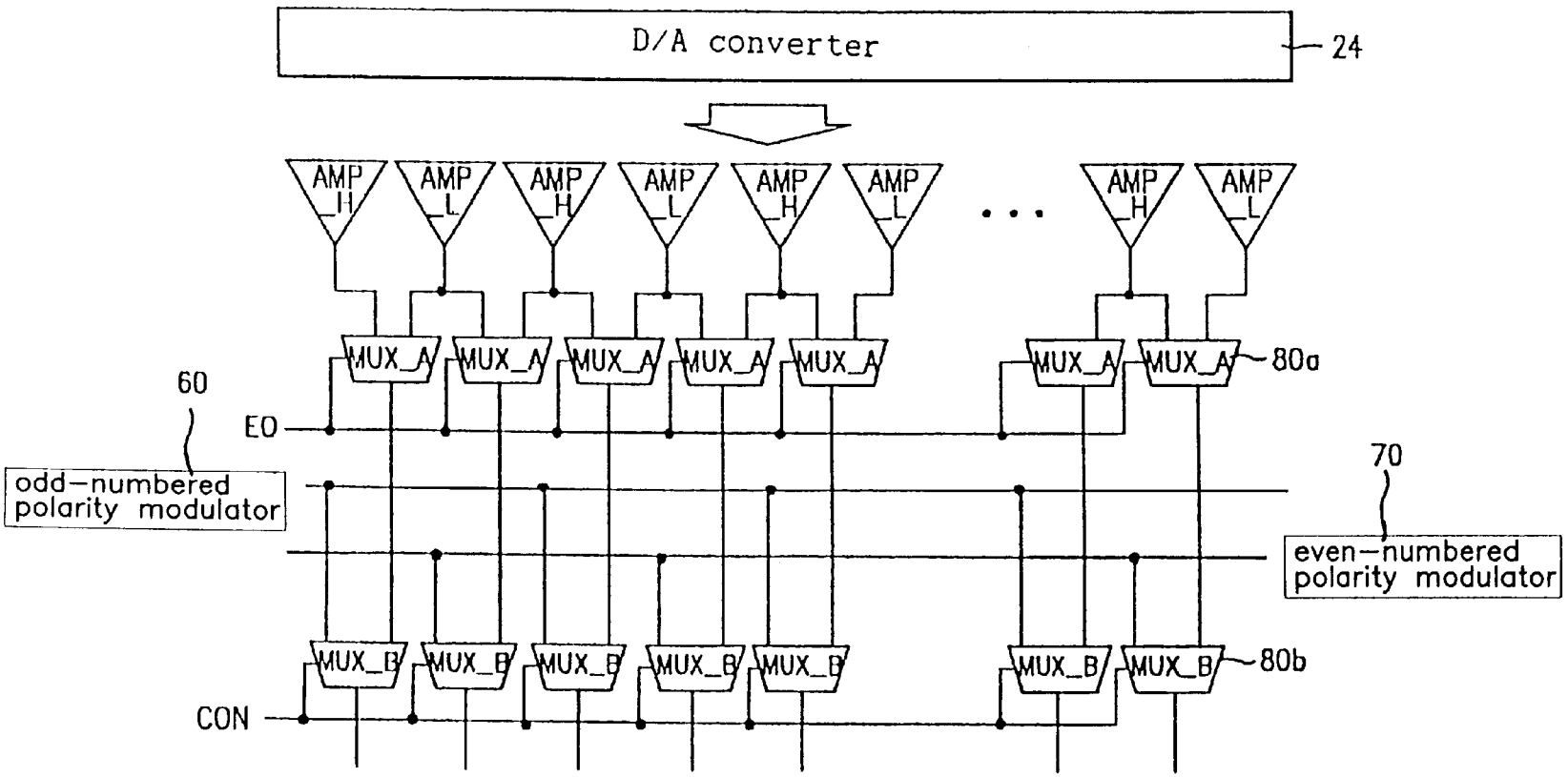
Figure 10C:
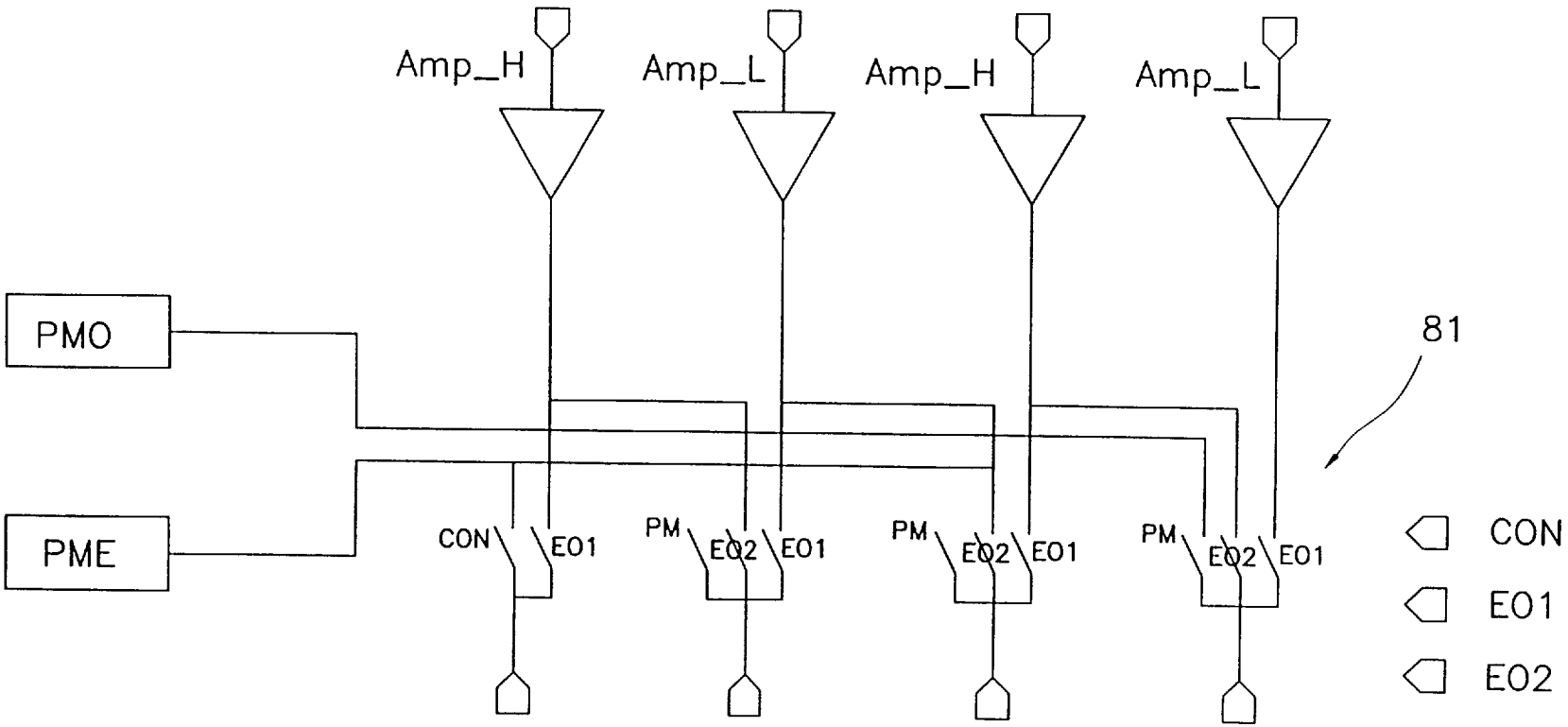
Figure 11A:
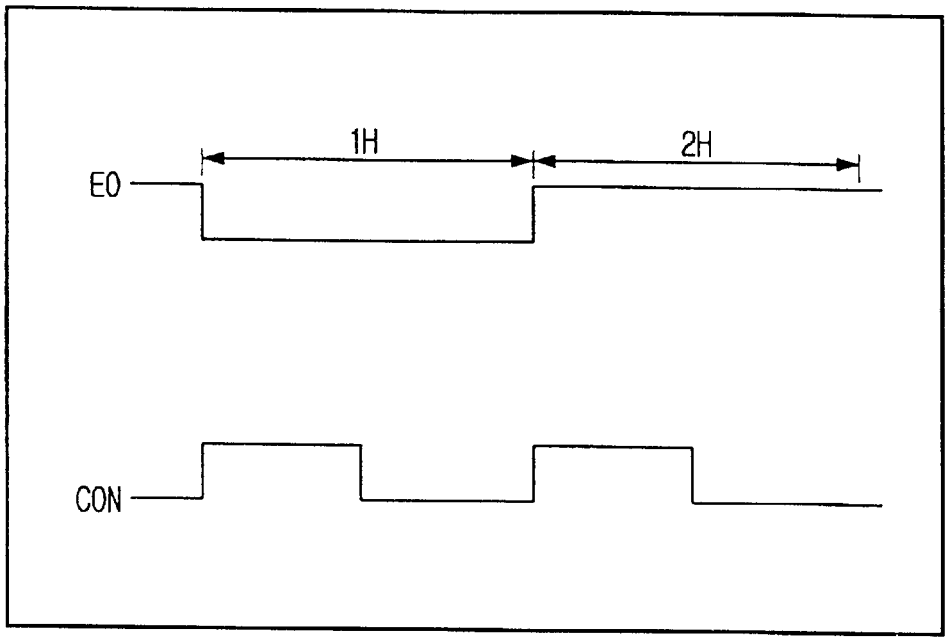
Figure 11B:
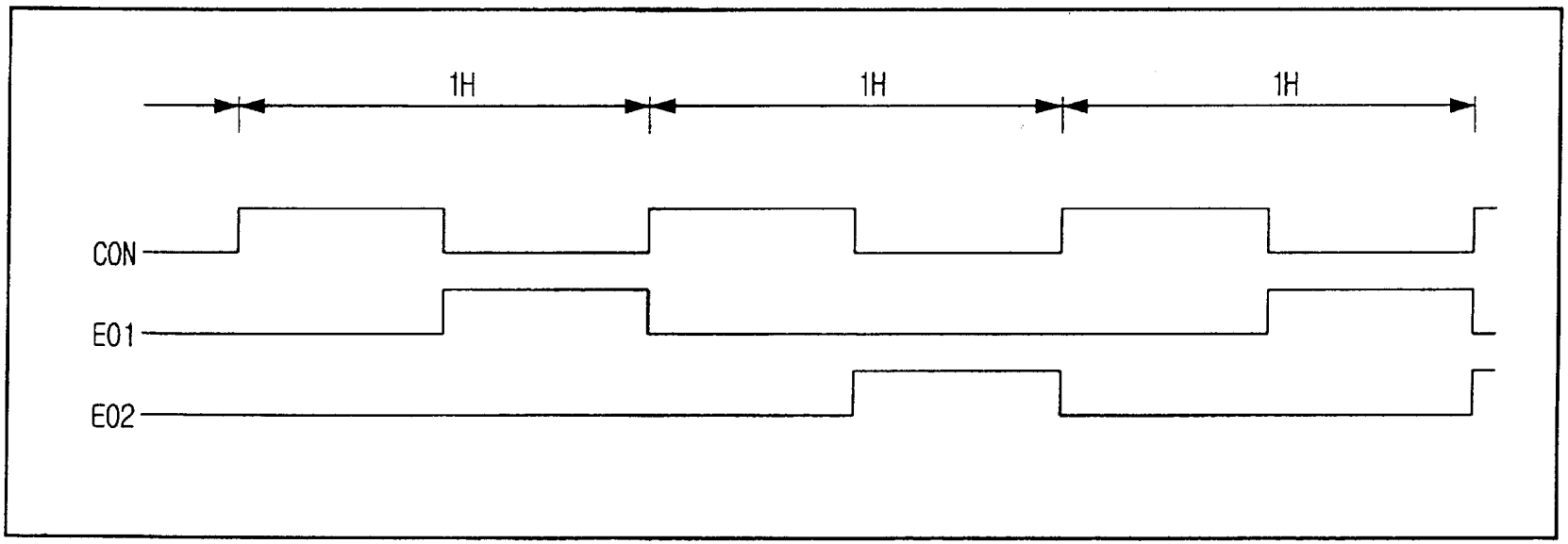
Figure 12A:
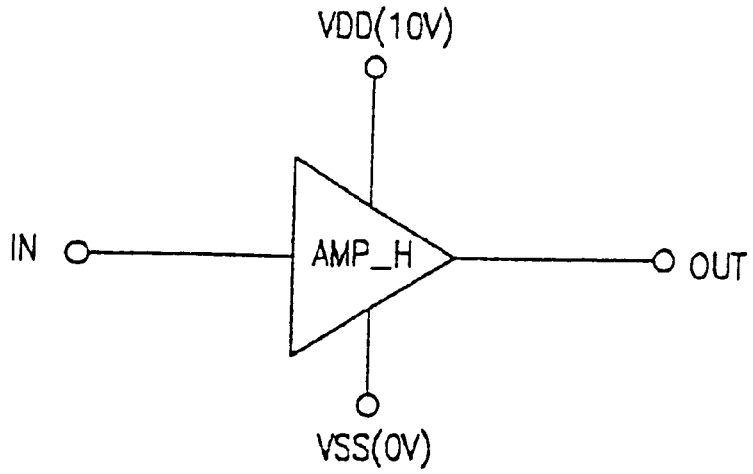
Figure 12B:
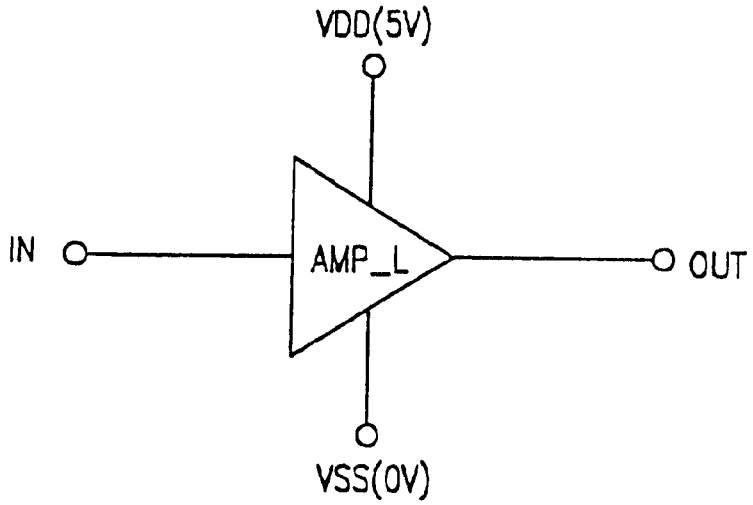
Figure 13:
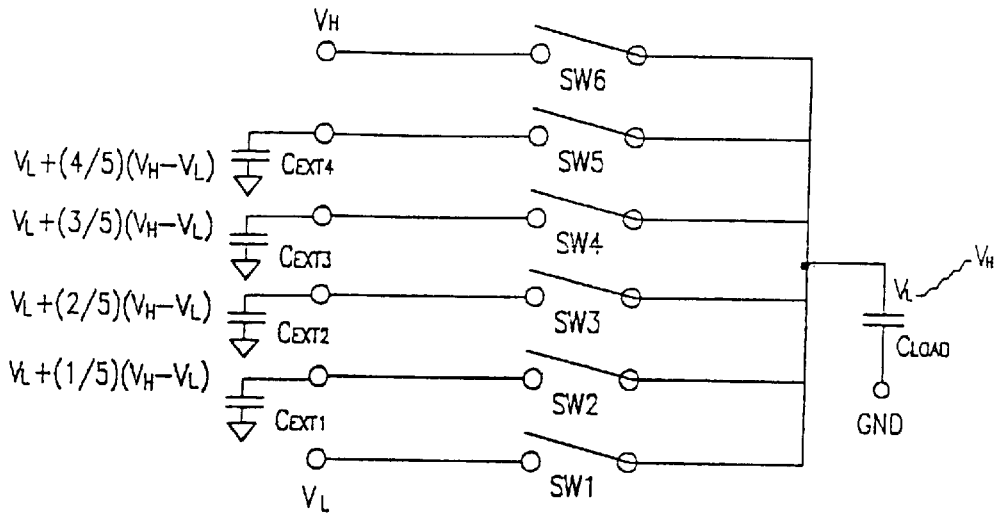
Figure 14:
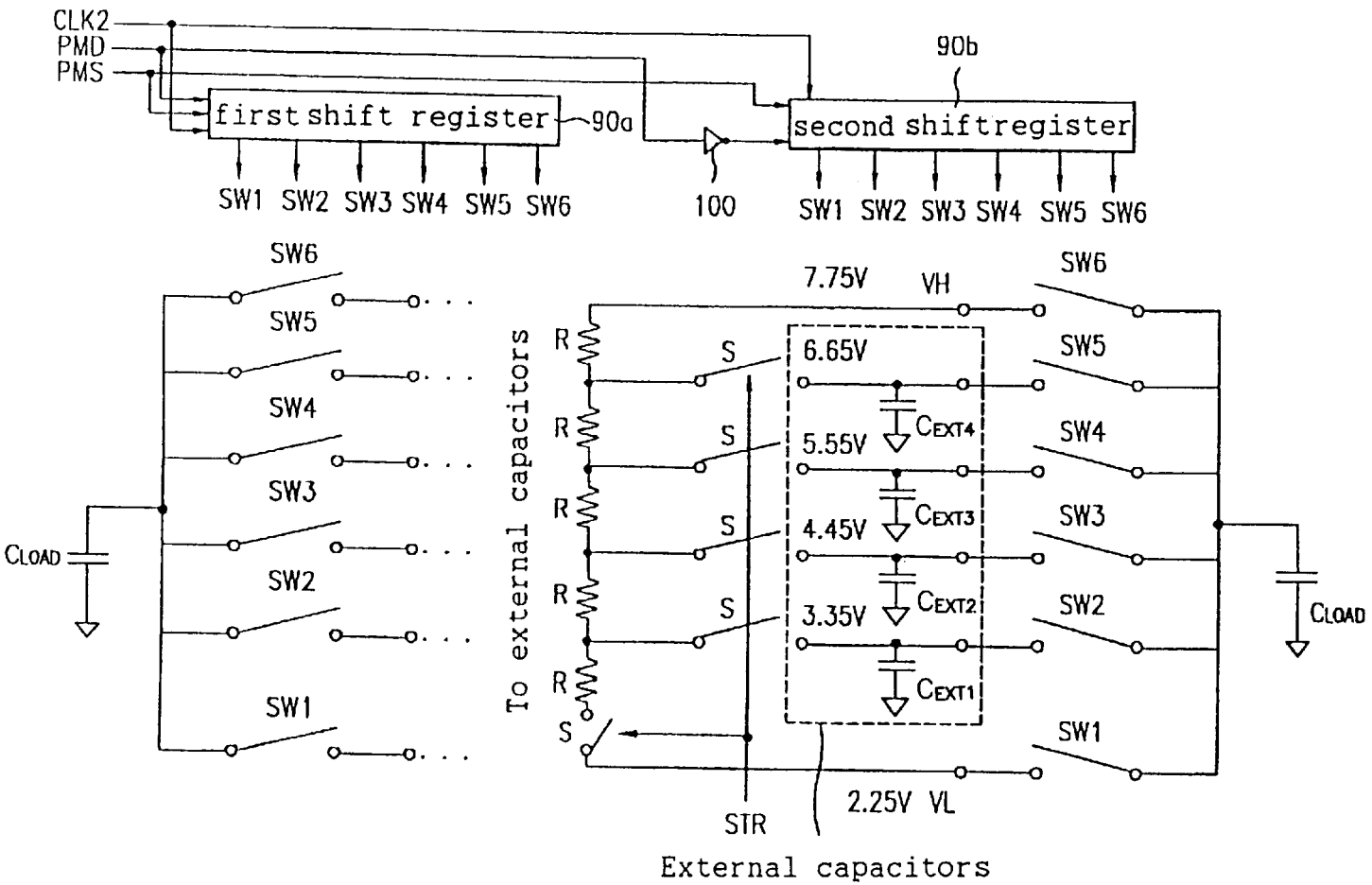
Figure 15:
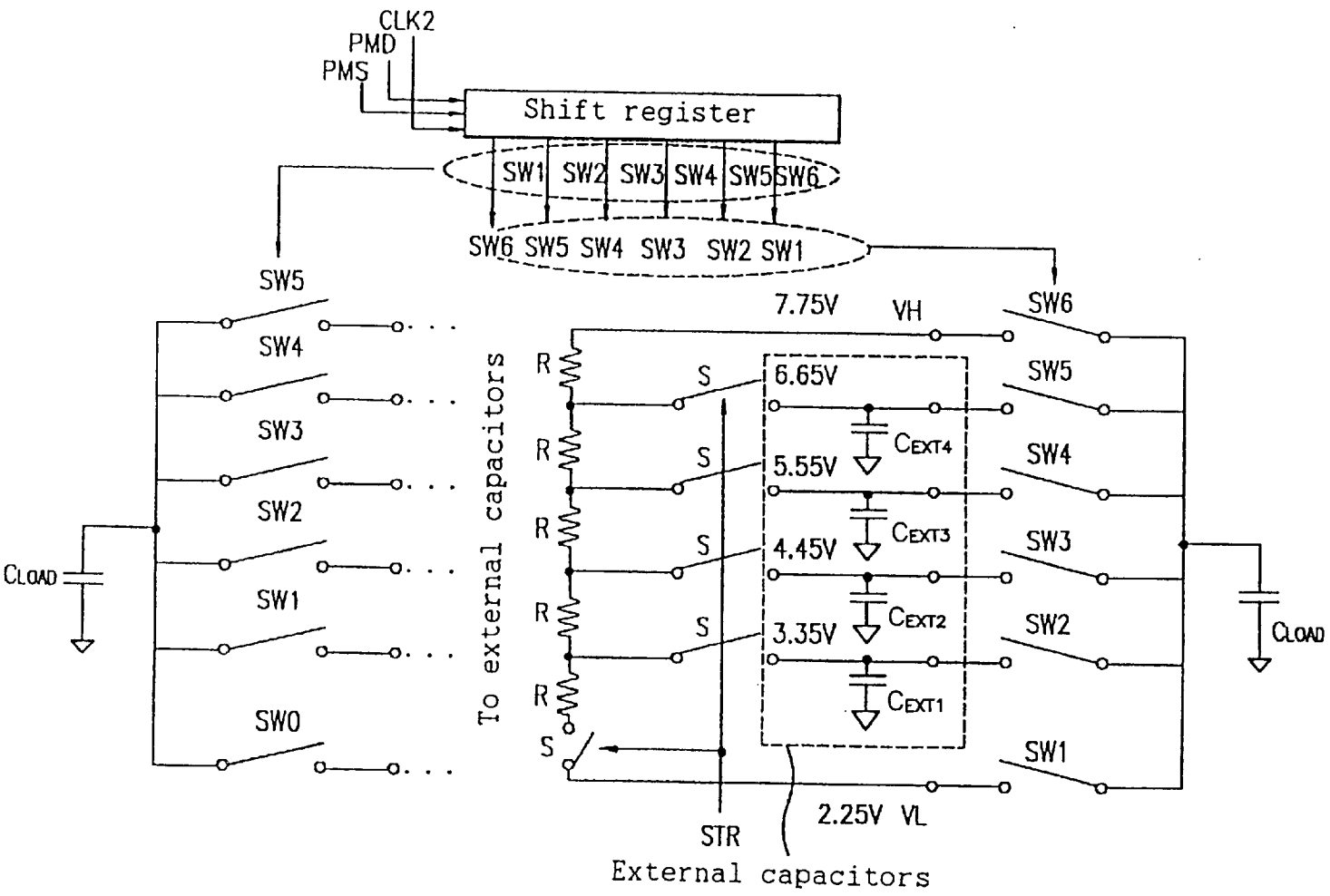
Figure 16:
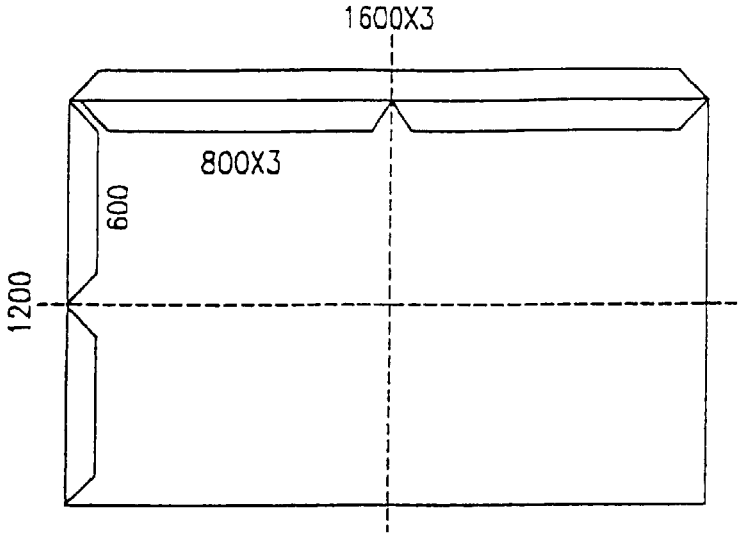
Figure 17:
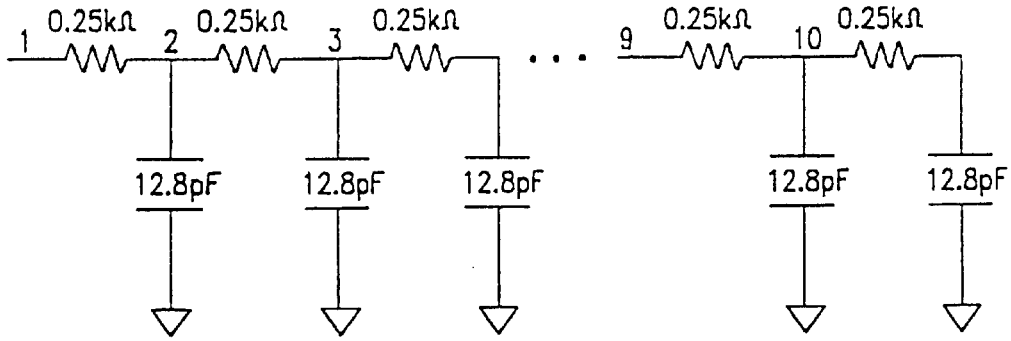
Figure 18:
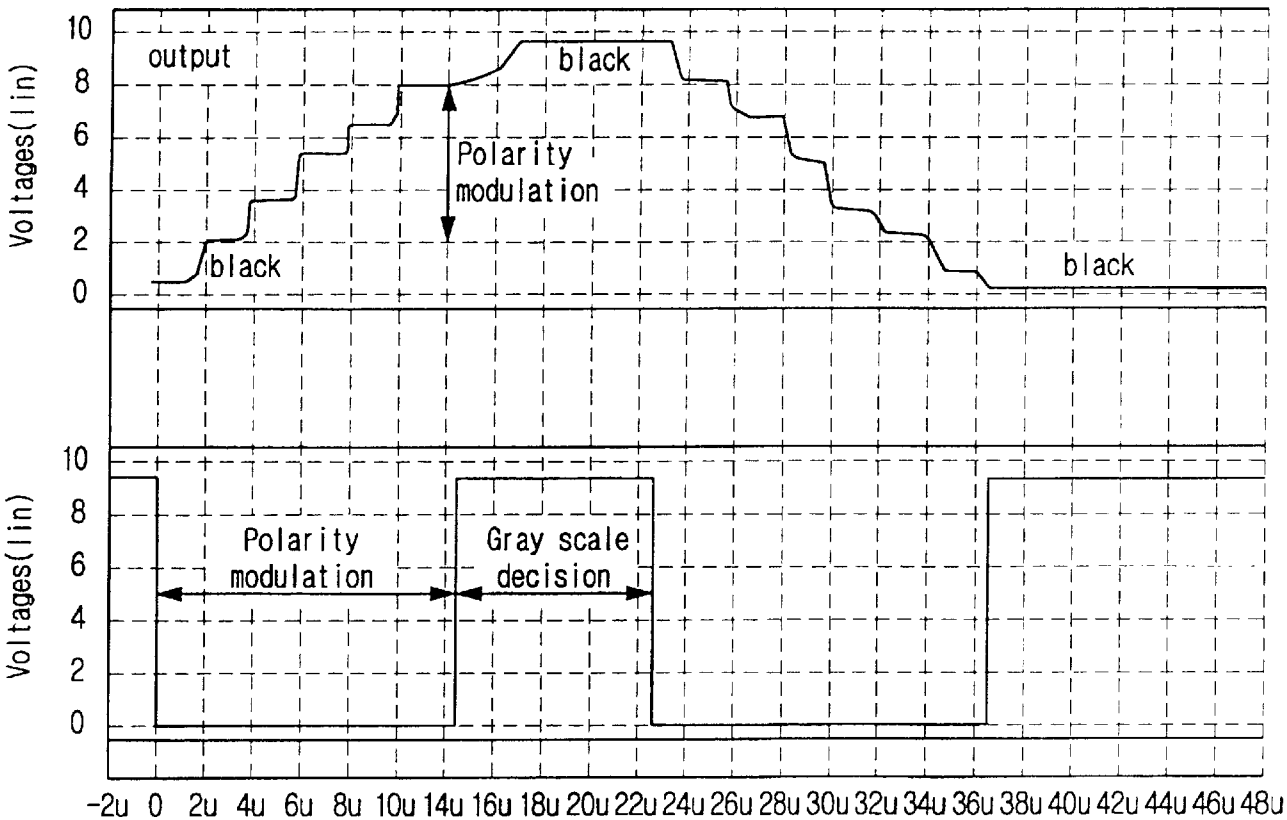
Figure 19:
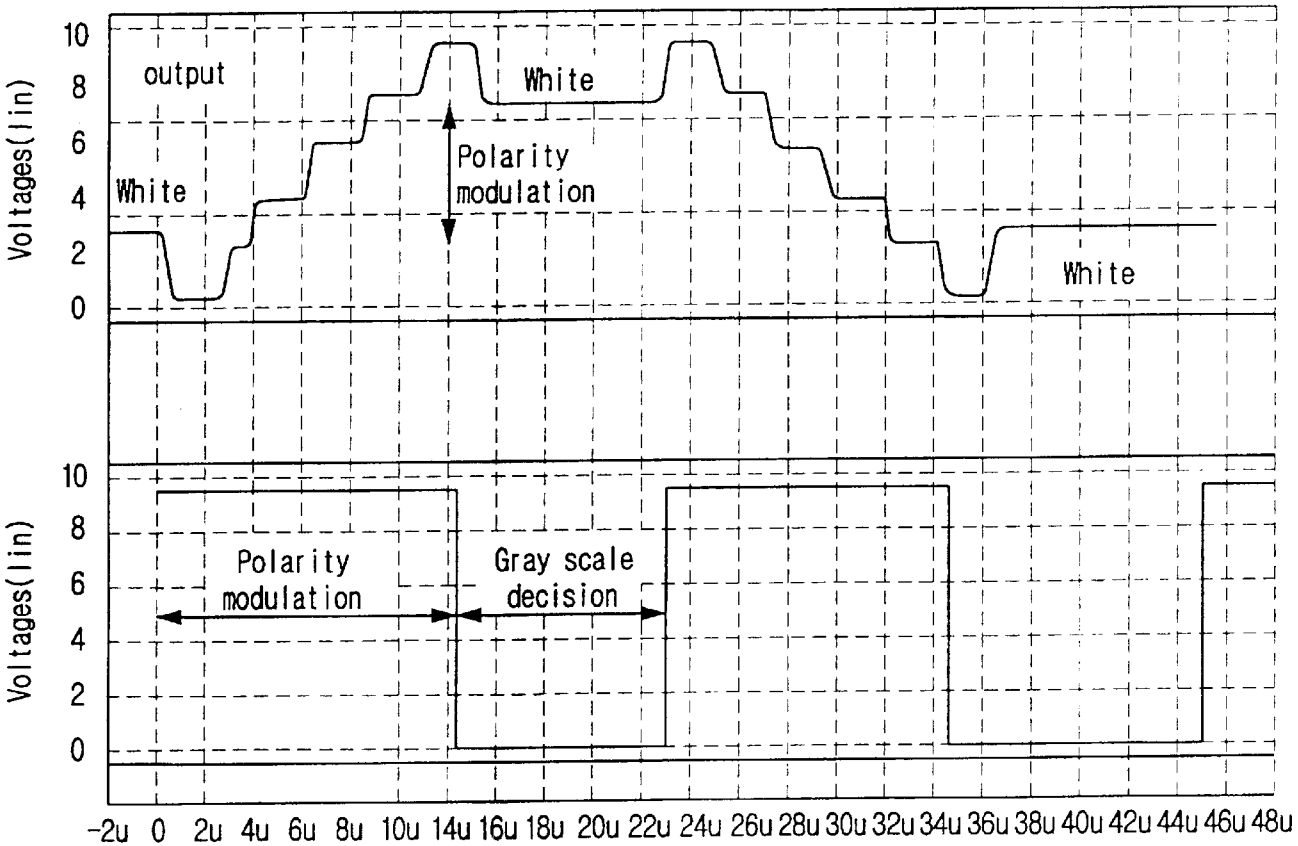

FIGS. 10A, 10B, and 10C show the configuration of a source driving circuit of a TFT-LCD according to the present invention;

FIGS. 11A and 11B show waveforms of control signals for controlling the MUX_A and MUX_B or switches of FIGS. 10A, 10B, and 10C;

FIGS. 12A and 12B are circuit diagrams of amplifiers of the output buffer of FIGS. 10B and 10C;

FIG. 13 is a circuit diagram of a polarity modulator;

FIG. 14 shows an example of the polarity modulating circuit for driving the source driving circuit according to the present invention;

FIG. 15 shows another example of the polarity modulating circuit for driving the source driving circuit according to the present invention;

FIG. 16 shows a 30-inch UXGA panel;

FIG. 17 shows a load model being divided into ten segments;

FIG. 18 shows a driving signal waveform and a control signal waveform for displaying an all-black image; and FIG. 19 shows a driving signal waveform and a control signal waveform for displaying an all-white image.

DETAILED DESCRIPTION OF PREFERRED EMBODIMENT

Reference will now be made in detail to the preferred embodiments of the present invention, examples of which are illustrated in the accompanying drawings.

Figure 8:
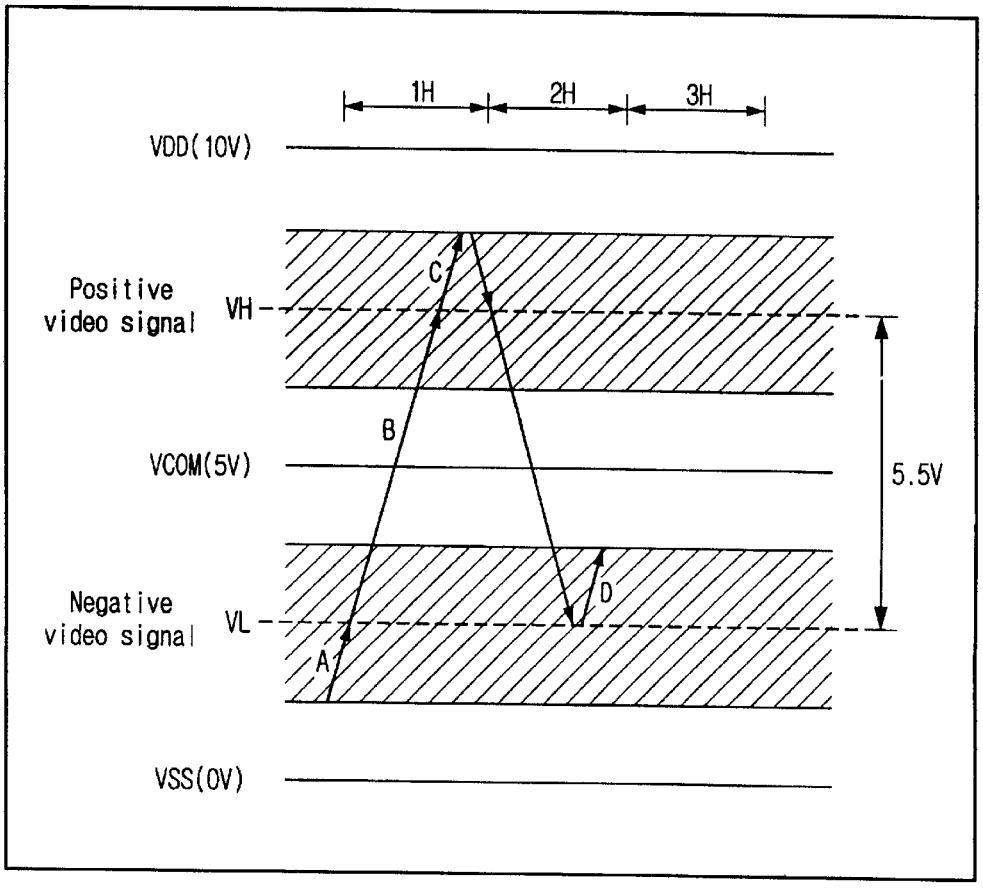
FIG. 8 shows the output waveform of a source driving circuit according to the dot inversion method in accordance with the present invention.

FIG. 8 illustrates the operating range of a video signal according to the dot inversion mode in accordance with the present invention.

In the stepwise source driving method as a source driving method for a TFT-LCD according to the present invention, the transmission of a video signal is performed, being divided into 2-phase of polarity modulation and gray scale decision. Referring to FIG. 8, a voltage swing B ranging between a voltage VL corresponding to the medium gray of the negative video signal and a voltage VH corresponding to the medium gray of the positive video signal is executed according to the polarity modulation, and then voltage swings C and D for deciding gray scale are accomplished by an amplifier of a source driver. Here, the voltages VL and VH are not needed to be limited to the medium voltages of the negative and the positive video signals, and they can be arbitrary voltages within the negative and the positive video signals.

The power consumption according to the dot inversion driving method of the present invention is described below, being divided into the one due to the polarity modulation and the other one due to the gray scale decision. Referring to FIG. 8, the consumption power due to the polarity modulation B is provided by the polarity modulation voltage VH while the consumption power required for the gray scale display C (black image in this case) is provided by the power supply VDD of the amplifier. Furthermore, to display a white image after polarity modulation into the voltage VL within the negative video region needs the voltage swing D which is also provided by the power supply VDD of the amplifier. However, when a black image is displayed after polarity modulation into the voltage VL within the negative video region, power consumption caused by the amplifier does not occur but power consumption due to the polarity modulation voltage VL generates when there is executed the polarity modulation back into the voltage VH within the positive video region. This is arranged in the following table 1.

TABLE 1

| Voltage swing | A | B | C | D |
|---|---|---|---|---|
| Power supply | Polarity modulation VL | Polarity modulation VH | Amplifier | Amplifier |

The table 1 shows the occurrence of power consumption according to the dot inversion driving method of the present invention.

Figure 9A:
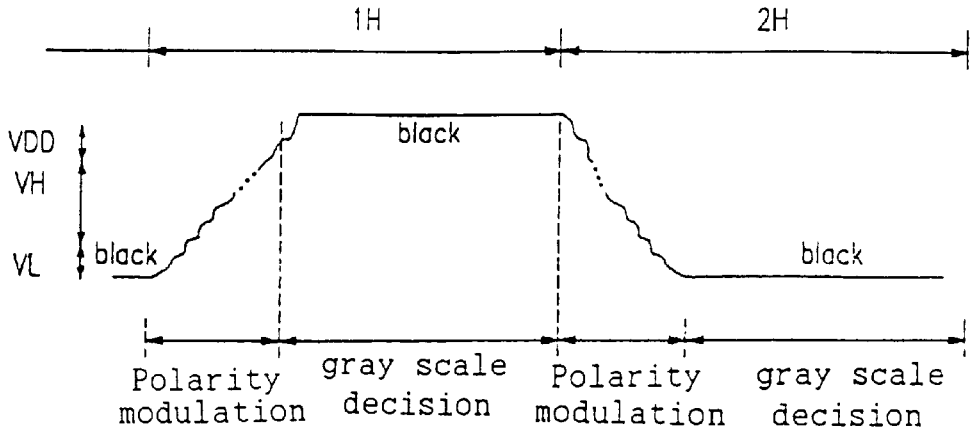
FIG. 9A shows the waveform of a driving signal of an all-black image in the stepwise source driving method.
Figure 9B:
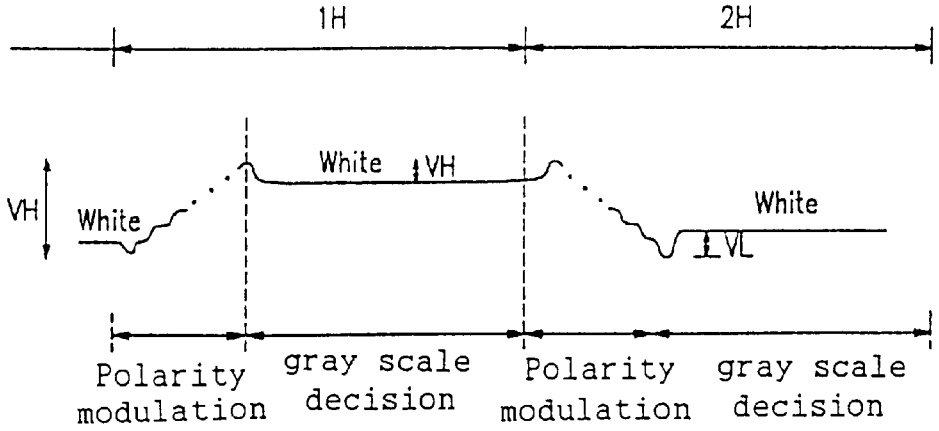
FIG. 9B shows the waveform of a driving signal of an all-white image in the stepwise source driving method.

FIGS. 9A and 9B illustrate driving signal waveforms of a stepwise source driving circuit of the present invention, exemplifying case of an all-black image and case of an all-white image, respectively. That is, FIG. 9A shows the driving signal waveform of the all-black image in the stepwise source driving method, and FIG. 9B shows the driving signal waveform of the all-white image in the stepwise source driving method.

Referring to FIGS. 9A and 9B, the dot inversion method according to the present invention drives the source lines with one horizontal period H being divided into two phases of polarity modulation and gray scale decision. In this stepwise source driving method, the polarity modulation with a wide voltage swing width reduces the consumption power using charge recovery through stepwise charging and allows the amplifier to supply only the consumption power required for gray scale display, to thereby decrease the driving consumption power.

There will be described the configuration of the source driving circuit of the TFT-LCD, capable of reducing the consumption power, according to the present invention.

FIGS. 10A, 10B, and 10C show the configuration of the source driving circuit of the TFT-LCD according to the present invention. Referring to FIG. 10A, a plurality of multiplexers (MUXs) 80 or switches 81 select one of the output signal of an output buffer 50 and the output signals of an odd-numbered polarity modulator 60 and an even-numbered polarity modulator 70 in response to an external control signal CON, and transmit the selected one to the pixels.

In the dot inversion of the TFT-LCD, since the signal polarities of neighboring source lines are opposite to each other, the stepwise charge driving directions in the source lines are also opposite to each other. That is, in case where stepwise charging is carried out in an odd-numbered source line capacitor, stepwise discharging should be performed in an even-numbered source line capacitor. Also, switches constructing the polarity modulator operate in opposite orders to each other. Accordingly, the source driving circuit of the present invention has the odd-numbered polarity modulator 60 and the even-numbered polarity modulator, separately set from each other, to separately drive the odd-numbered source lines and the even-numbered source lines.

Figure 1:
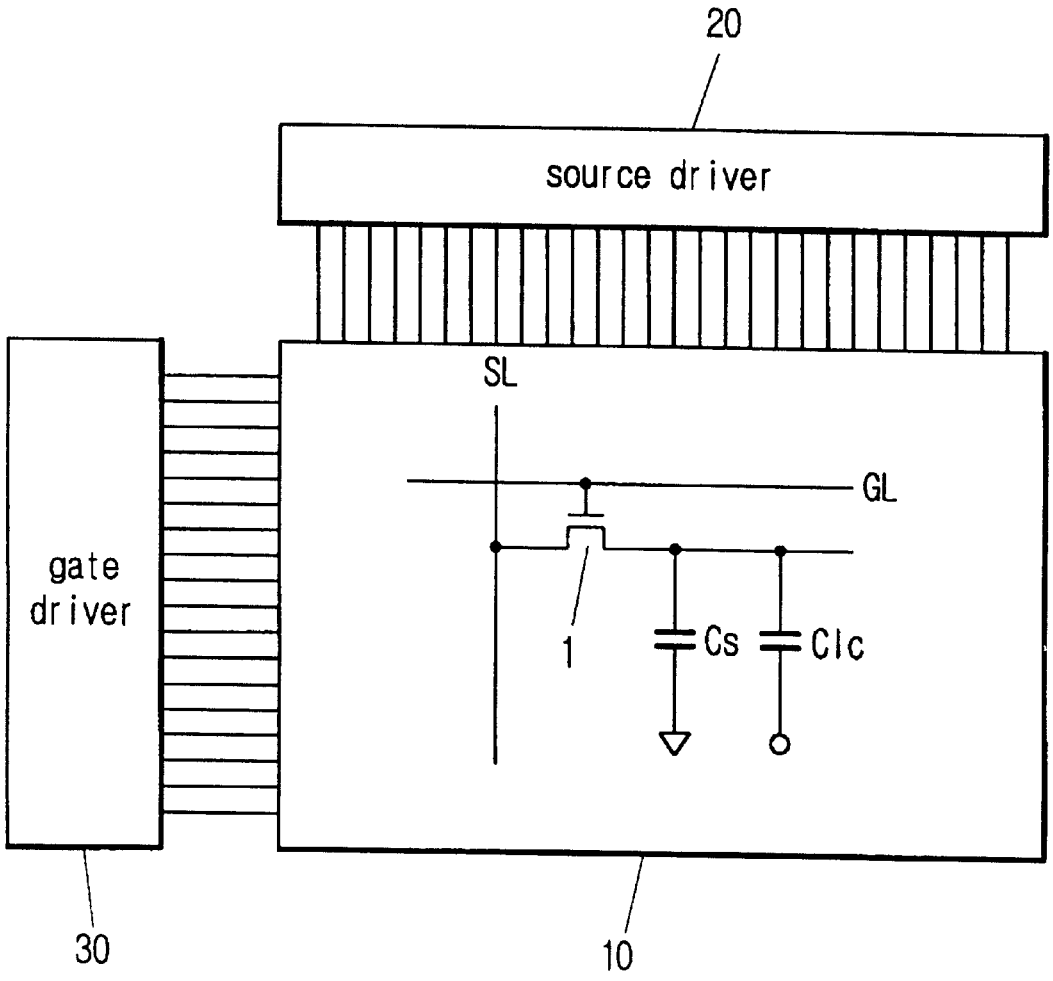
Fig.1 (Prior Art)
FIG. 1 shows the configuration of a conventional TFT-LCD.
Figure 2:
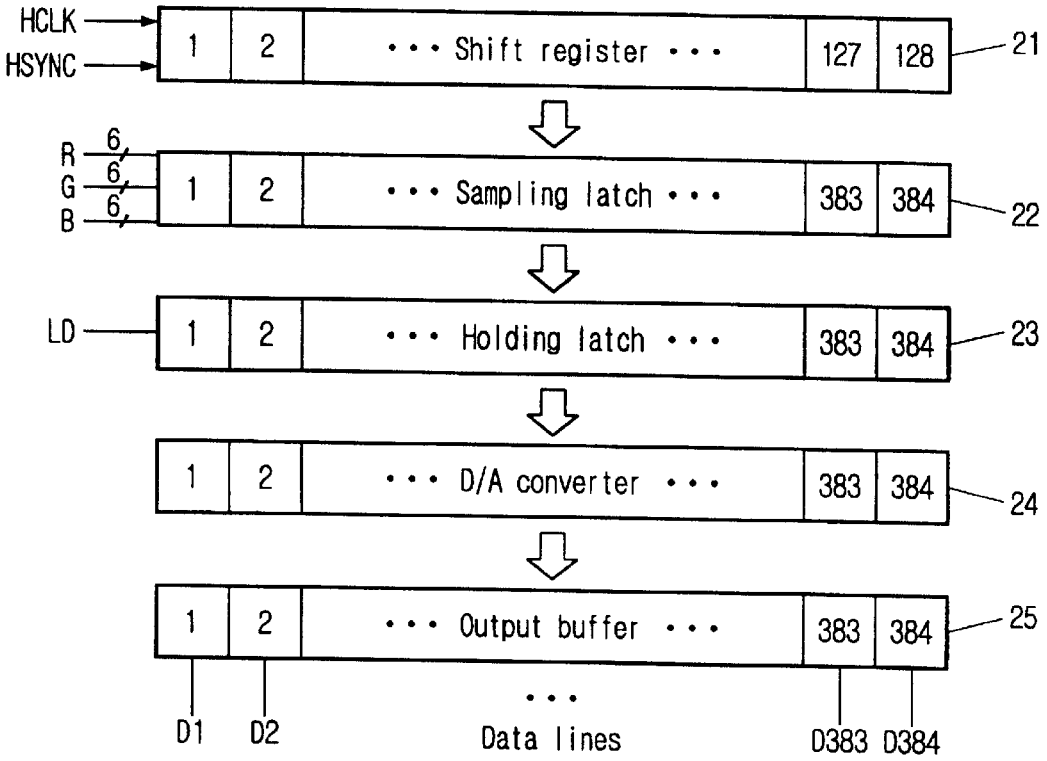
Fig.2 (Prior Art)
FIG. 2 shows the configuration of a source driving circuit of the conventional TFT-LCD.
Figure 3:
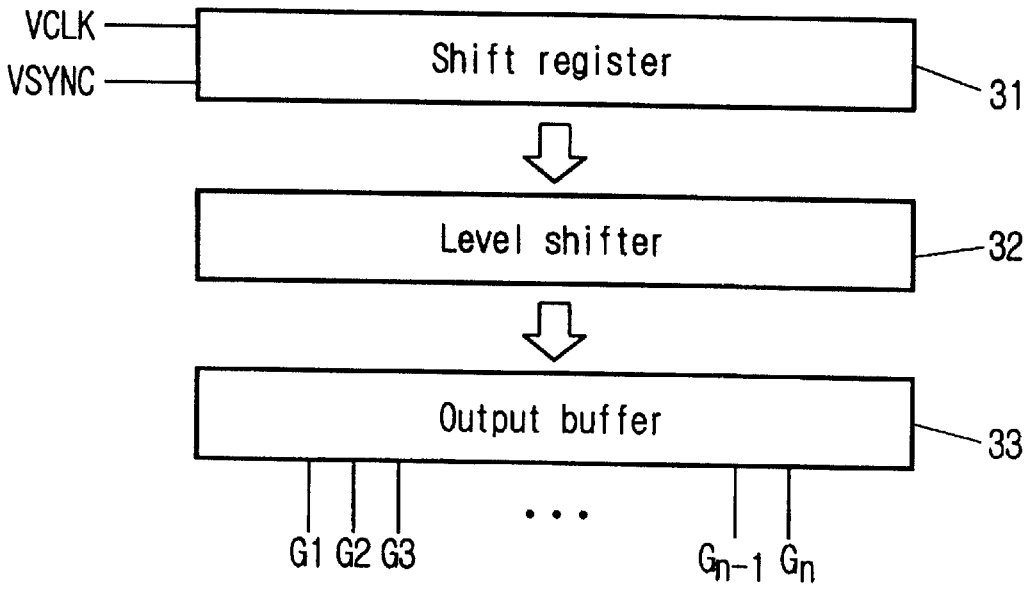
Fig.3 (Prior Art)
FIG. 3 shows the configuration of a gate driving circuit of the conventional TFT-LCD.
Figure 4:
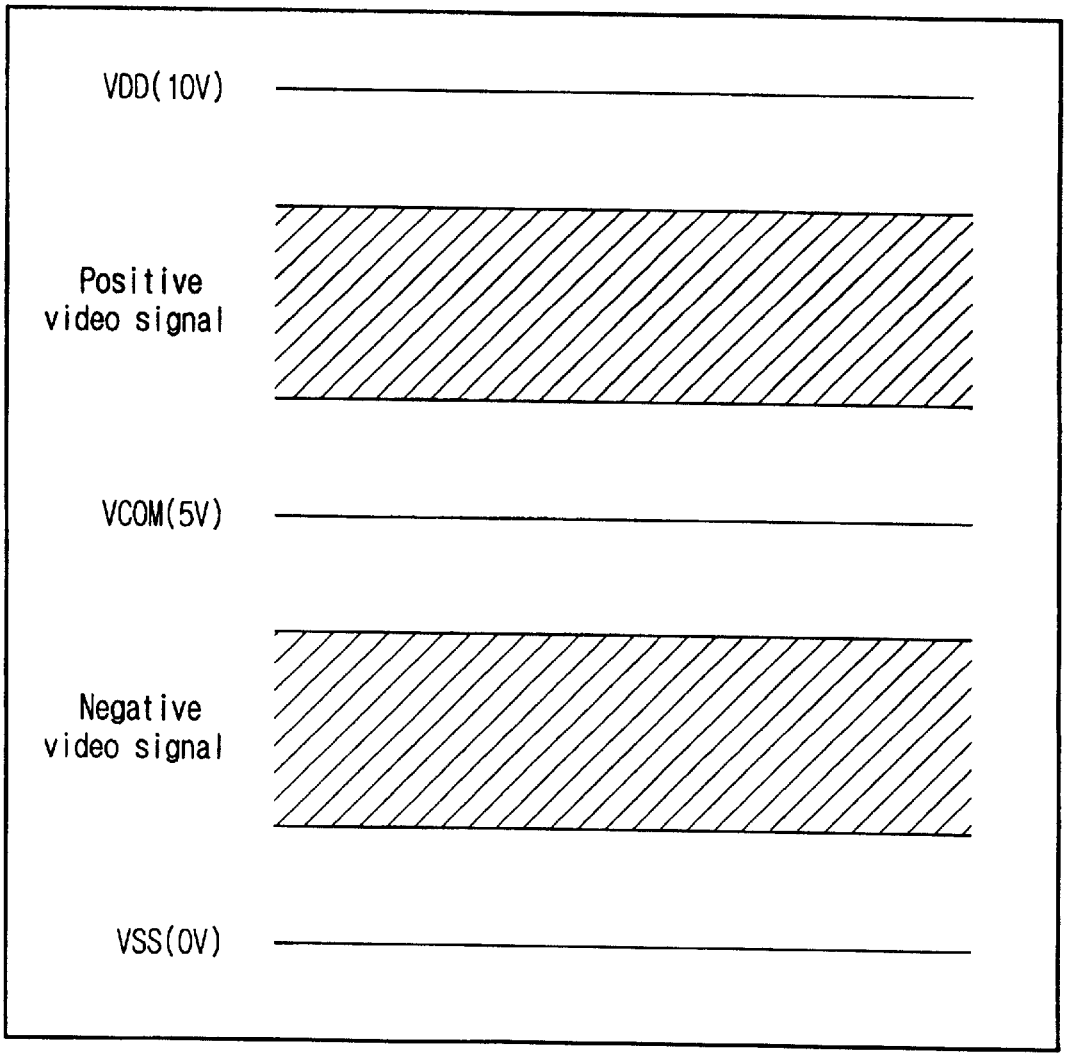
FIG. 4 shows the voltage range of the video signal of FIG. 1.

The source driving circuit of the TFT-LCD according to the present invention includes the output buffer 50 for amplifying the current of the analog data signal converted by the digital/analog converter 24 of FIG. 2 and outputting it to the source lines of the panel, the odd-numbered polarity modulator 60 for driving the odd-numbered source lines, the even-numbered polarity modulator 70 for driving the even-numbered source lines, and the plurality of MUXs 80 or switches 81 for selecting one of the output signal of the output buffer 50 and the output signals of the odd-numbered and the even-numbered polarity modulators 60 and 70 in response to the external control signal CON and outputting it to the pixels.

That is, the source driving circuit of the TFT-LCD according to the present invention has the same configuration as the source driving circuit of the conventional TFT-LCD, excepting the section following the output buffer, i.e., the odd-numbered and the even-numbered polarity modulators 60 and 70 and the MUXs 80 or switches 81. The MUXs 80 determine the polarity modulation and the gray scale decision according to the external control signal CON.

Referring to FIG. 10B, there are provided a first multiplexing part MUX_A 80*a* receiving the output signals of the output buffer 50 consisting of amplifiers AMP_H and AMP_L for amplifying the current of the analog data signal converted by the digital/analog converter 24 of FIG. 2 and selecting one of the output signals in response to an external control signal EO to output the selected one to the pixels, and a second multiplexing part MUX_B 80*b* receiving the output signals of the first multiplexing part 80*a* and the odd-numbered and the even-numbered polarity modulators 60 and 70 and selecting one of them in response to the external control signal CON to output the selected one to the pixels.

And, FIG. 10C is the more simple circuit than that of FIGS. 10A and 10B. Instead of the plurality of the first multiplexing part MUX_A 80*a* and the second multiplexing part MUX_B 80*b* for each column, three switches 81 may be used as shown in FIG. 10C. The PMO and PME shown in FIG. 10C mean the Polarity Modulator for Odd-numbered Columns and Polarity Modulator for Even-numbered Columns, respectively.

FIG. 11A shows the waveforms of the control signals for controlling the MUX_B and MUX_A of FIGS. 10A and 10B, and FIG. 11B shows the waveforms of the control signals for controlling the switches of FIG. 10C, and FIGS. 12A and 12B are circuit diagrams of the amplifiers of the output buffer of FIGS. 10B and 10C. Referring to FIG. 11A, the polarity modulation is carried out when the control signal CON is in "1" state and the gray scale decision is performed when the control signal CON is in "0" state. Here, the control signal CON controls the MUX_B of FIGS. 10A and 10B while the control signal EO controls the MUX_A of FIG. 10A.

The circuit shown in FIG. 10C is operated by the control signals shown FIG. 11B. In the operation of the circuit, the polarity modulation is carried out when the control signal CON is in "1" state (CON=1) and the gray scale decision is performed when the control signal CON is in "0" state (CON=0). In the gray scale decision, the decision of displaying the positive or negative video signal depends on when EO1=1 or EO2=1.

The amplifier of the output buffer 50 includes two kinds of AMP_H and AMP_L which have different power voltages VDD from each other as shown in FIGS. 12A and 12B. That is, the AMP_H (VDD=10V) is for only the gray scale of the positive video region and the AMP_L (VDD=5V) is for only that of the negative video region.

Figure 6:
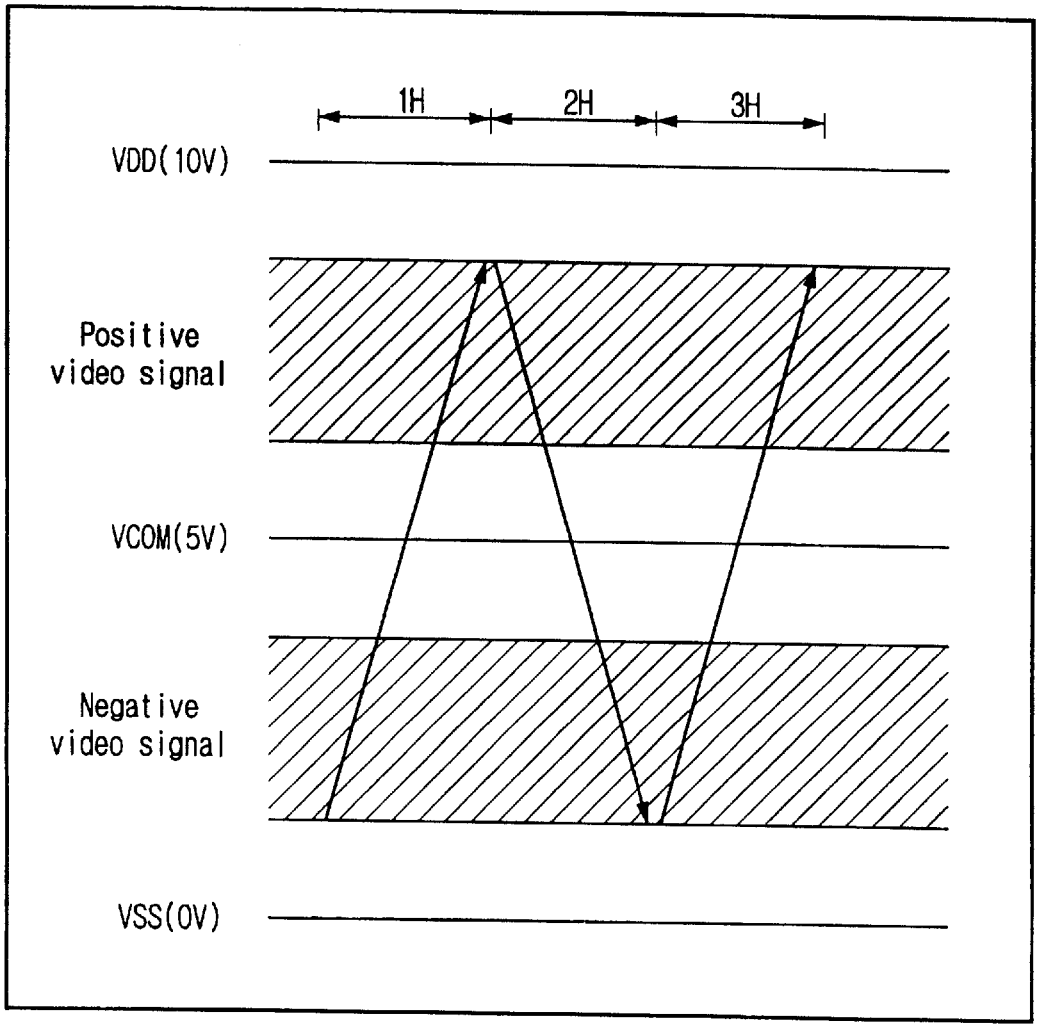
FIG. 6 shows the output waveform of the conventional source driving circuit according to the dot inversion method.
Figure 7:
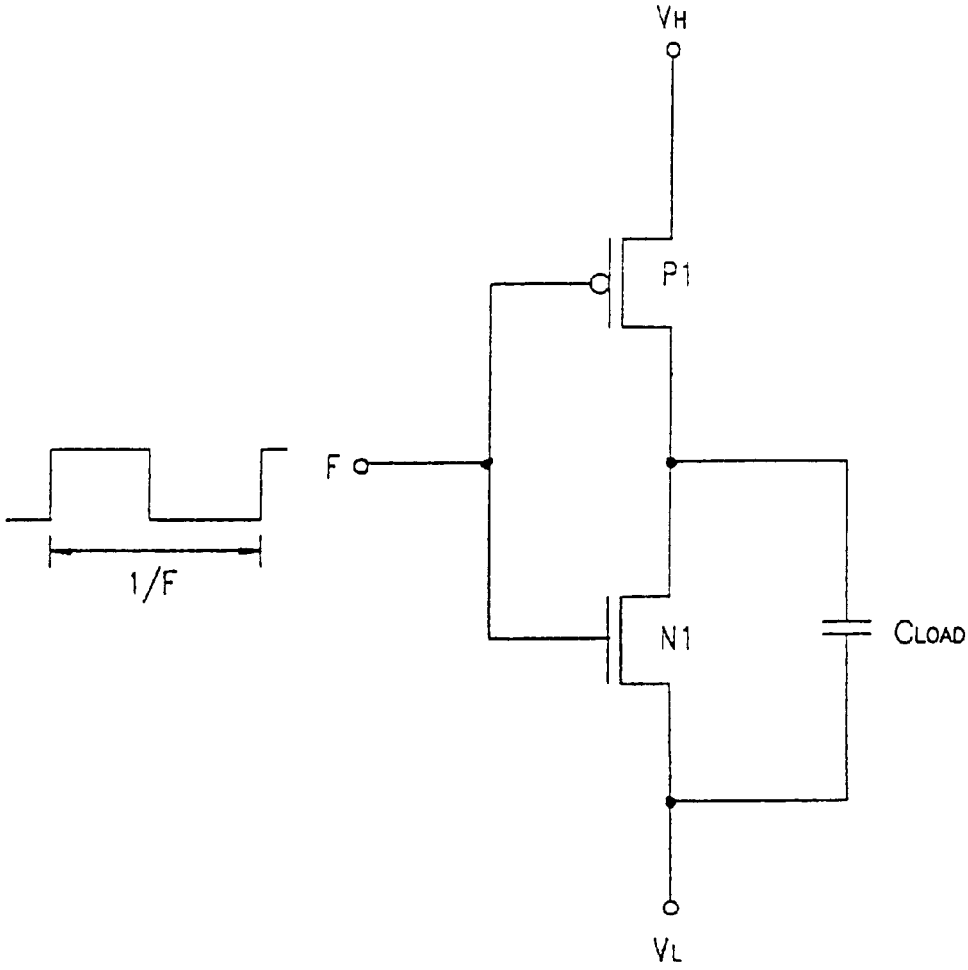
FIG. 7 is a circuit diagram of a general CMOS for driving a capacitance load.

Furthermore, it is possible to use a low-voltage amplifier when the negative video signal is transmitted as shown as D of FIG. 6, to reduce the consumption power compared to the case where only a high-voltage amplifier is employed. The configuration of the odd-numbered and the even-numbered polarity modulators is explained in more detail below.

FIG. 13 is a circuit diagram of each polarity modulator. Referring to FIG. 13, when a load capacitor $C_{LOAD}$ is driven by stepwise voltages obtained by dividing the voltage ranging from the $V_L$ to $V_H$ by 5 (generally, N), the consumption power $P_{STEPWISE}$ decreases to ⅕ (generally, 1/N) of the consumption power represented by the equation (1). This is shown in the following equation (2).

$$P_{STEPWISE}=C_{LOAD}V_HF(V_H-V_L)/5=P_{CONV}/5 \quad (2)$$

Here, the load capacitance $C_{LOAD}$ is the sum of the capacitances of M column lines, where M corresponds to ½ of the number of outputs of a single source driver.

In the source driving method for the present invention, the polarity modulating circuit PM is required to perform polarity modulation of the even-numbered columns and polarity modulation of the odd-numbered columns opposite to each other for the dot inversion driving so that a single source driving circuit should be in charge of the even-numbered and the odd-numbered columns, dividing them from each other. Thus, two polarity modulating circuits PM are required for one source driving circuits. For example, when this method is applied to the source driving circuit of a TFT-LCD having 300 outputs, M becomes 150.

External capacitors $C_{EXT1}$, $C_{EXT2}$, $C_{EXT3}$, and $C_{EXT4}$ are capacitors which are set outside the source driver chip, the size of each one corresponding to one hundred times that of M load capacitors $C_{LOAD}$, approximately. These external capacitors $C_{EXT1}$, $C_{EXT2}$, $C_{EXT3}$, and $C_{EXT4}$ are respectively charged with $V_L+(4/5)(V_H-V_L)$, $V_L+(3/5)(V_H-V_L)$, $V_L+(2/5)(V_H-V_L)$, and $V_L+(1/5)(V_H-V_L)$, which are obtained by equally dividing the difference voltage between the $V_H$ and $V_L$. Here, $V_H$ is higher than $V_L$. In addition, the $V_H$, $V_L$ and the external capacitors $C_{EXT1}$, $C_{EXT2}$, $C_{EXT3}$ and $C_{EXT4}$ are connected to the load capacitor $C_{LOAD}$ via switches SW6, SW5, SW4, SW3, SW2, and SW1, which are turned on or turned off according to an external signal, respectively.

Meantime, the stepwise source driving method should provide sufficiently short period of time required for each step and small driving circuit size in addition to reduction effect of the consumption power, to be actually used for driving the source lines of the TFT-LCD.

There will be explained the reason why the consumption power of the stepwise source driving circuit employing the polarity modulating circuit used as the source driving circuit of the TFT-LCD of the present invention is reduced.

Referring to FIG. 13, when it is assumed that the external capacitors $C_{EXT1}$, $C_{EXT2}$, $C_{EXT3}$, and $C_{EXT4}$ are initially charged with the voltages, there equally exists the difference of ⅕ between the voltages of neighboring external capacitors. When is assumed that the load capacitor $C_{LOAD}$ is initially charged with the voltage $V_L$, and it is desired to be charged up to $V_H$, the switches are sequentially turned on, from SW1 to SW6. In doing so, the voltage thereof increases from $V_L$ to $V_H$ stepwise and the voltage of each step corresponds to the result that corresponding external capacitor has been charged.

On the contrary, when the load capacitor $C_{LOAD}$ is discharged from $V_H$ to $V_L$, the switches are sequentially turned on from SW6 to SW1 opposite to the case of charging. Here, $V_L+(1/5)(V_H-V_L)$, provided to the load capacitor $C_{LOAD}$ while each external capacitors is charged up to $V_H$, is returned while discharging to $V_L$ so that the power that each external capacitor supplies to the load capacitor $C_{LOAD}$ becomes "0" substantially.

Furthermore, power supply according to $V_H$ is accomplished by turning on the switch SW6. Here, because the load capacitor $C_{LOAD}$ has been charged with $V_L+(4/5)(V_H-V_L)$ right before the switch SW6 is turned on, the voltage substantially charged by $V_H$ is ⅕ $(V_H-V_L)$ and the consumption power decreases to ⅕ as shown in the equation (1).

FIG. 14 is a circuit diagram of an embodiment of the polarity modulating circuit for driving the source driving circuit according to the present invention. Referring to FIG. 14, the odd-numbered polarity modulator 60 and the even-numbered polarity modulator 70 share the external capacitors. Resistors R are for determining the initial charging voltages of the external capacitors. When switches S controlled by a signal STR at the initial operation stage of the source driving circuit is turned on, current flows through the resistors R so that voltage distribution is carried out according to the resistors and each distributed voltage is stored at each external capacitor. Once a desired voltage is stored at each external capacitor, the switches are turned off by the STR signal, to prevent unnecessary current from flowing through the resistors to occur power consumption. Accordingly, the resistors can be integrated inside the source driver chip while the external capacitors are set outside the chip as shown in FIG. 13.

First and second shift registers 90*a* and 90*b* shown in FIG. 14 generate a signal for controlling the switches SW1–SW6 of the stepwise source driving circuit. The signal controlling each switch is internally generated inside the source driver chip using these first and second shift registers 90*a* and 90*b* rather than it is externally provided from the outside of the chip so that the number of input signals can be reduced. In FIG. 14, CLK2 is a clock signal used for the first and the second shift registers 90*a* and 90*b*, PMS is a trigger signal of the first and the second shift registers 90*a* and 90*b* and PMD is a signal determining shift direction.

When the PMD signal of "1" is applied to the first shift register 90*a*, the second shift register 90*b* is provided with "0" This can be accomplished in such a manner that an inverter 100 is set before the first or the second shift registers 90*a* or 90*b* to apply the signals opposite to each other to the shift registers. This is required because, in the odd-numbered polarity modulator 60 and even-numbered polarity modulator 70, since the order of turning on and turning off the switches of one of them is opposite to that of the other one, the order of the turn-on signal applied to the switches of one of them should be opposite to that of the other one.

Alternatively, instead of the first and the second shift registers 90*a* and 90*b*, only one shift register may be used as shown in FIG. 15. In this case, the connection order of the switched may be arranged oppositely to that of FIG. 14.

There will be explained below simulation results with respect to the timing of the dot inversion method of the present invention and the size of the circuit used therein.

For example, the present invention is applied to 30-inch UXGA panel and 14-inch XGA panel. Mostly, the 30-inch UXGA panel is described hereinafter.

As shown in FIG. 16, since 30-inch LCD panels currently developed operate by four-division driving, the present invention performs simulations on the assumption that the 30-inch UXGA panel also operates by the four-division driving. In case of the four-division driving, each of the four divided panels corresponds to a 15-inch SVGA panel. Here, the column lines operate with the load of C=128 pF and R=2.5 kΩ and the line time is equal to 22 μsec. The values C and R are obtained through Raphael 3D simulation for typical pixels. A load model divided into 10 segments as shown in FIG. 17 is used because C and R are dispersed in the actual source lines.

Let it be assumed that the 5-step method as shown in FIG. 13 is used, the period of time required for the polarity modulation is limited below ½ of one horizontal period 1H and the remaining period of time is allocated to the period of time required for the gray scale display according to the amplifier, the XGA panel has the line time of 16 μsec approximately and the SVGA panel has the line time of 22 μsec approximately. Thus, the permitted step time periods in the XGA and SVGA panel are respectively 1.5 μsec and 2 μsec approximately. The transistor sizes of the switches of FIG. 13 for the purpose of satisfying this timing condition are arranged in tables 2, 3, 4, and 5.

Here, each switch may be configured of only NMOS transistor or configured of NMOS and PMOS transistors, the channel length of each transistor being commonly 0.6 μm. In addition, in the polarity modulation, each switch (NMOS transistor) is provided with 10V and 0V to be turned on and turned off, respectively, because a voltage of 2.25~7.75V should be supplied to the load capacitor $C_{LOAD}$. On the contrary, in case of the switch configured of a PMOS transistor, it is provided with 0V and 10V to be turned on and turned off, respectively, which is opposite to the above case.

TABLE 2

The sizes of transistors when the step time is 1.5 μsec and each switch is configured of an NMOS transistor

| Switch | SW1 | SW2 | SW3 | SW4 | SW5 | SW6 |
|---|---|---|---|---|---|---|
| Size (μm) | 400 | 400 | 400 | 500 | 500 | 600 |

As shown in table 2, each of the switches is configured of only NMOS transistor, with SW1, SW2, and SW3 having the size of 400 μm, SW4 and SW5 having the size of 500 μm, and SW6 transmitting the highest voltage having the size of 600 μm.

The following table 3 shows the sizes of the transistors when the switch SW6 transmitting the highest voltage is configured of a PMOS. Since the switch SW6 should transmit the highest voltage, it is desirable that 0V is applied as the turn-on signal to increase the value of $|V_{GS}|$.

TABLE 3

The sizes of transistors when the step time is 1.5 μsec and the switches are configured of NMOS and PMOS transistors

| Switch | SW1 | SW2 | SW3 | SW4 | SW5 | SW6 |
|---|---|---|---|---|---|---|
| Type | N | N | N | N | N | P |
| Size (μm) | 400 | 400 | 400 | 500 | 500 | 600 |

As shown in table 3, it is advantageous in terms of the transistor size that the switch SW6 is configured of the PMOS transistor rather than the NMOS transistor.

TABLE 4

The sizes of transistors when the step time is 2.0 μsec and each switch is configured of an NMOS transistor

| Switch | SW1 | SW2 | SW3 | SW4 | SW5 | SW6 |
|---|---|---|---|---|---|---|
| Size (μm) | 100 | 100 | 100 | 200 | 200 | 300 |

TABLE 5

The sizes of transistors when the step time is 2.0 μsec and the switches are configured of NMOS and PMOS transistors

| Switch | SW1 | SW2 | SW3 | SW4 | SW5 | SW6 |
|---|---|---|---|---|---|---|
| Type | N | N | N | N | N | P |
| Size (μm) | 100 | 100 | 100 | 200 | 200 | 250 |

There will be arranged in the following tables the result of power consumption simulation according to the above-described source driving circuit of the LCD according to the present invention. The conditions for the power consumption simulation is shown in Table 6.

TABLE 6

Conditions for power consumption simulation

| Diagonal length | Resolution | Frame frequency | Load | Remarks |
|---|---|---|---|---|
| 30 inches | UXGA | 75 | C = 255 ρF<br>R = 5 kΩ | four-division driving |

Here, the result of AC power consumption simulation in the stepwise source driving method is compared with the result of AC power consumption simulation in the conventional high-voltage driving method. FIG. 18 shows driving waveforms and control signals when the panel displays an all-black image, and FIG. 19 shows driving waveforms and control signals when the panel displays an all-white image. FIGS. 18 and 19 show the results obtained by performing HSPICE simulation under the conditions of the table 6. That is, the polarity modulation or gray scale decision are carried out according to the control signal CON.

Meanwhile, current values and consumption powers are arranged in the following tables 7, 8, and 9. Here, VDDH and VDDL of Table 7 correspond to the power voltages of AMP_H and AMP_L shown in FIGS. 12A and 12B, respectively.

TABLE 7

Comparison of consumption powers for displaying all-black image

| | Stepwise source driving | | | | Conventional high-voltage driving |
|---|---|---|---|---|---|
| Power | VDDH | VDDL | VH | VL | VDD |
| Voltage (V) | 10 | 5 | 7.75 | 2.25 | 10 |
| Average AC current value (μA) | 3.8 | 0 | 3.2 | 3.6 | 23.1 |
| AC consumption power (mW) | 91.2 | 0 | 59.5 | 19.4 | 554.4 |
| AC consumption power (mW) of each of 4 divided panels | | 170.1 | | | 554.4 |
| AC consumption power (mW) of entire panel | | 680.4 | | | 2218 |

TABLE 8

Comparison of consumption powers for displaying all-white image

| | Stepwise source driving | | | | Conventional high-voltage driving |
|---|---|---|---|---|---|
| Power | VDDH | VDDL | VH | VL | VDD |
| Voltage (V) | 10 | 5 | 7.75 | 2.25 | 10 |
| Average AC current value (μA) | 0 | 3.6 | 6.9 | 0 | 8.7 |
| AC consumption power (mW) | 0 | 43.2 | 128.3 | 0 | 208.8 |
| AC consumption power (mW) of each of 4 divided panels | | 171.5 | | | 208.8 |
| AC consumption power (mW) of entire panel | | 686 | | | 835.2 |

TABLE 9

Comparison of consumption powers for displaying all-medium gray image

| | Stepwise source driving | | | | Conventional high-voltage driving |
|---|---|---|---|---|---|
| Power | VDDH | VDDL | VH | VL | VDD |
| Voltage (V) | 10 | 5 | 7.75 | 2.25 | 10 |
| Average AC current value (μA) | 0 | 0 | 3.2 | 0 | 16.0 |
| AC consumption power (mW) | 0 | 0 | 59.5 | 0 | 384 |
| AC consumption power (mW) of each of 4 divided panels | | 59.5 | | | 384 |
| AC consumption power (mW) of entire panel | | 238 | | | 1536 |

According to the stepwise source driving method of the present invention, the consumption power required for the polarity modulation with a wide voltage swing width is reduced using charge recovery through the stepwise charging, and the amplifier supplies only the amount of consumption power required for the gray scale display, to thereby decrease the driving consumption power.

It will be apparent to those skilled in the art that various modifications and variations can be made in the circuit for driving the source of a liquid crystal display of the present invention without departing from the spirit or scope of the invention. Thus, it is intended that the present invention cover the modifications and the variations of this invention provided they come within the scope of the appended claims and their equivalents.

What is claimed is:

1. A source driving circuit for a liquid crystal display having a shift register, a sampling latch, a holding latch, a digital/analog converter, and an output buffer, comprising:

n external capacitors charged with stepwise voltages between an upper voltage (VH) and a lower voltage (VL), respectively, wherein n is an integer no less than 2;

a first polarity modulator for performing stepwise polarity modulation of odd-numbered source lines connected to the n external capacitors by providing load capacitors connected to the odd-numbered source lines with the stepwise polarity voltages from the n external capacitors and recovering at the n external capacitors the stepwise polarity voltages from the load capacitors connected to odd-numbered source lines;

a second polarity modulator for performing stepwise polarity modulation of even-numbered source lines connected to the n external capacitors by providing load capacitors connected to the even-numbered source lines with the stepwise polarity voltages from the n external capacitors and recovering at the n external capacitors the stepwise polarity voltages from the load capacitors connected to even-numbered source lines, wherein the n external capacitors are connected to both the first polarity modulator and the second polarity modulator; and a plurality of multiplexers for selecting the output of the first polarity modulator or the second modulator in a polarity modulation phase, selecting an output of the output buffer in a gray scale phase, and for then outputting the selected outputs to pixels.

2. The circuit as claimed in claim 1, wherein the n external capacitors are set outside of a source driver chip, and each of the first and the second polarity modulators is configured of a plurality of switches connecting the n external capacitors to a power supplier or the source lines of the liquid crystal display.

3. The circuit as claimed in claim 2, wherein each of the switches is configured of an NMOS transistor.

4. The circuit as claimed in claim 3, wherein the NMOS transistors constructing the switches have different sizes from one another.

5. The circuit as claimed in claim 2, wherein each of the switches is configured using NMOS and PMOS transistors.

6. The circuit as claimed in claim 2, wherein the n external capacitors are charged with voltages obtained by equally dividing a voltage value ranging from a predetermined gray value of a negative video signal to a predetermined gray value of a positive video signal.

7. The circuit as claimed in claim 2, wherein each of the external capacitors has a size larger than that of the load capacitors.

8. The circuit as claimed in claim 1, wherein each of the first and second polarity modulators includes first and second shift registers, respectively, having shift directions opposite to each other.

9. The circuit as claimed in claim 1, wherein each of the first and second polarity modulators includes a single shift register having switch connection orders opposite to each other.

10. A source driving circuit for a liquid crystal display having a shift register, a sampling latch, a holding latch, a digital/analog converter, and an output buffer, comprising:

n external capacitors charged with stepwise voltages between an upper voltage (VH) and a lower voltage (VL), respectively, wherein n is an integer no less than 2;

a first polarity modulator for performing stepwise polarity modulation of odd-numbered source lines connected to the n external capacitors by providing load capacitors connected to odd-numbered source lines with the stepwise polarity voltages from the n external capacitors and recovering at the n external capacitors the stepwise polarity voltages from the load capacitors connected to odd-numbered source lines;

a second polarity modulator for performing stepwise polarity modulation of even-numbered source lines connected to the n external capacitors by providing load capacitors connected to even-numbered source lines with the stepwise polarity voltages from the n external capacitors and recovering at the n external capacitors the stepwise polarity voltages from the load capacitors connected to even-numbered source lines, wherein the n external capacitors are connected to both the first polarity modulator and the second polarity modulator; and a plurality of switches for selecting the output of the first polarity modulator or the second modulator in a polarity modulation phase, selecting an output of the output buffer in a gray scale phase, and for then outputting the selected outputs to pixels.

11. The circuit as claimed in claim 10, wherein the n external capacitors are set outside of a source driver chip, and each of the first and the second polarity modulators is configured of a plurality of switches connecting the n external capacitors to a power supplier or the source lines of the liquid crystal display.

12. The circuit as claimed in claim 11, wherein each of the switches is configured of an NMOS transistor.

13. The circuit as claimed in claim 12, wherein the NMOS transistors constructing the switches have different sizes from one another.

14. The circuit as claimed in claim 11, wherein each of the switches is configured using NMOS and PMOS transistors.

15. The circuit as claimed in claim 11, wherein then external capacitors are charged with voltages obtained by equally dividing a voltage value ranging from a predetermined gray value of a negative video signal to a predetermined gray value of a positive video signal.

16. The circuit as claimed in claim 11, wherein each of the external capacitor has the size larger than that of the load capacitor.

17. The circuit as claimed in claim 10, wherein each of the first and second polarity modulators includes first and second shift registers, respectively, having shift directions opposite to each other.

18. The circuit as claimed in claim 10, wherein each of the first and second polarity modulators includes a single shift register having switch connection orders opposite to each other.

* * * * *